US006942063B1

(12) United States Patent
Huett, Jr.

(10) Patent No.: US 6,942,063 B1
(45) Date of Patent: Sep. 13, 2005

(54) EXTENSION LADDER ATTACHMENT

(76) Inventor: Joseph T. Huett, Jr., 337 N. Simpson St., Mt. Dora, FL (US) 32757

( * ) Notice: Subject to any disclaimer, the term of this patent is extended or adjusted under 35 U.S.C. 154(b) by 0 days.

(21) Appl. No.: 10/638,591

(22) Filed: Aug. 11, 2003

(51) Int. Cl.[7] ..... E04G 1/00; E06C 7/06; E06C 7/14; E06C 7/16

(52) U.S. Cl. ..... 182/129; 182/214; 182/121; 248/210

(58) Field of Search ..... 182/129, 107, 182/214, 121, 122, 230; 248/210, 211, 238

(56) References Cited

U.S. PATENT DOCUMENTS

| | | | | |
|---|---|---|---|---|
| 2,407,541 | A * | 9/1946 | Ehnborn | 182/214 |
| 2,498,944 | A * | 2/1950 | Dyer | 182/121 |
| 4,212,371 | A * | 7/1980 | Gaviorno, Jr. | 182/121 |
| 4,696,373 | A * | 9/1987 | Page | 182/121 |
| 4,815,684 | A * | 3/1989 | Kellstadt | 248/210 |
| 4,909,351 | A * | 3/1990 | Johnson et al. | 182/121 |
| 5,191,954 | A * | 3/1993 | Ledford | 182/129 |
| 5,460,241 | A * | 10/1995 | LaBelle | 182/214 |
| 6,189,652 | B1 * | 2/2001 | Brown et al. | 182/121 |
| 6,367,754 | B1 | 4/2002 | Cinker | |
| 6,431,509 | B1 | 8/2002 | Proulx | |
| 6,474,607 | B1 | 11/2002 | Wilson | |
| 6,585,204 | B1 | 7/2003 | Haertzen | |
| 6,604,721 | B2 | 8/2003 | Ahl et al. | |

* cited by examiner

*Primary Examiner*—Hugh B. Thompson, II
(74) *Attorney, Agent, or Firm*—Polster, Lieder, Woodruff & Lucchesi, L.C.

(57) ABSTRACT

In combination with an extension ladder, an L-shaped bracket is provided. The bracket has at least one first leg longer than the distance between successive rungs of the ladder. The first leg is placed on one side of an upper rung and on the other side of a next lower rung. A short leg integral with the first leg projecting generally at right angles to the first leg, is placed on top of the upper rung and extends beyond the rung. It is adapted to support an accessory, such as a paint can or a tray. A clamp on the projecting leg insures against dislodgement of the holder. In the preferred embodiment, two L-shaped brackets are connected to an accessory carrying bar that projects beyond the sides of the rails of the ladder, and the clamp includes a plate wedging between the bar and a rail of the ladder.

8 Claims, 4 Drawing Sheets

EXTENSION LADDER ATTACHMENT

CROSS REFERENCE TO RELATED APPLICATIONS

STATEMENT REGARDING FEDERALLY SPONSORED RESEARCH OR DEVELOPMENT

BACKGROUND OF THE INVENTION

Painters, for example, often work on extension ladders, and need a place to hold the paint bucket in a convenient way. Commonly, a wire hook is mounted on a rung, and the paint can hung from the hook. This does not position the paint can conveniently, and there is always danger that it will become dislodged. Roofers are required to extend an extension ladder above the eaves, and then to step around the ladder onto the roof, an awkward and somewhat dangerous proceeding.

An object of this invention is to provide a simple device for holding paint cans or providing a shelf on which various accessories can be placed, or a platform from which a person wanting to get on a roof, can merely step, and hence, onto the roof.

BRIEF SUMMARY OF THE INVENTION

In accordance with this invention, generally stated, in combination with an extension ladder having elongated side rails and a multiplicity of rungs extending between and secured to the rails, an L-shaped attachment having at least one first leg longer than the distance between successive rungs is placed on one side of an upper rung and on the other side of a next lower rung. A short leg, integral with the first leg, projecting generally at right angles to the long leg, horizontally, is placed on top of the upper rung and extends beyond the rung. The short leg is adapted to support an accessory, either directly or by way of a support bar carried by two of the legs, spaced apart transversely of the ladder. Clamp means are provided for insuring against dislodgment of the attachment. The clamp means preferably includes a simple latch in the form of a plate wedged between the bar and a rail of the ladder. In the preferred embodiments, two long legs, spaced apart, support a crossbar, which in turn supports a bucket or buckets or a tray or platform. In this preferred embodiment, the holder is secured in position by a latch or a pair of latches each in the form of a plate wedged between the bar and a rail of the ladder.

DETAILED DESCRIPTION OF THE PREFERRED EMBODIIMENT OF THE INVENTION

Figure 1:
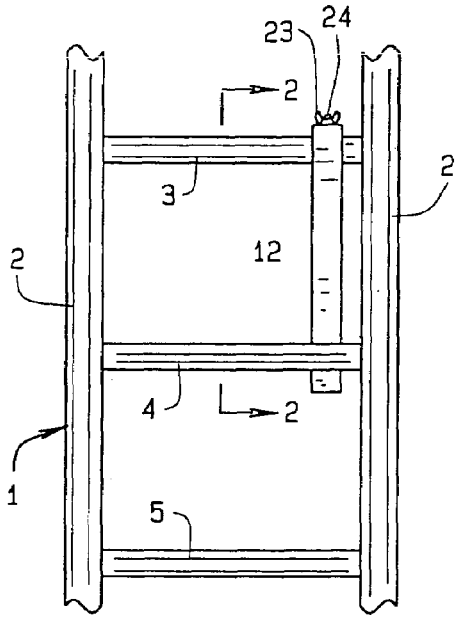
FIG. 1 is a fragmentary view in front elevation of a ladder with one embodiment of attachment if this invention.
Figure 2:
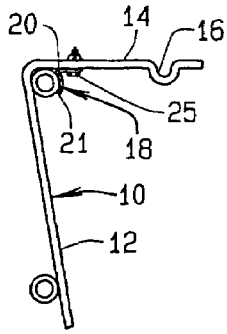
FIG. 2 is a sectional view taken along the line 2—2 of FIG. 1.
Figure 3:
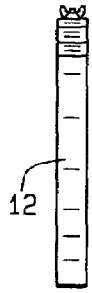
FIG. 3 is a view in rear elevation of the attachment of FIG. 1.

Referring to the drawings for preferred embodiments of this invention, and particularly to FIGS. 1–3, reference numeral 10 indicates the simplest of the attachments of this invention. The attachment 10 is mounted on a ladder 1 having side rails 2 and rungs 3, 4, and 5. The attachment 10 has a long leg 12, and a short leg 14. The long leg 12 in this embodiment is shown as extending behind a lower rung 4 and in front of a next higher rung 3. The short leg 14 extends over the higher rung 3 substantially horizontally with respect to the ground, the angle between the long leg 12 and the short leg 14 being generally a right angle, although, as can be seen from FIG. 2, the angle is not a true right angle, because the long leg is not exactly vertical. Depending upon the expected angle of the ladder with respect to the ground, the angle between the long leg 12 and the short leg 14 will approach a right angle. The term "generally at right angles" as used herein as applied to the angle between the long and short leg is used to indicate an angle that makes the short leg, in use, generally horizontal.

The short leg 14 has a bail-receiving channel 16 a short distance from its outer end. The short leg 14 also has a slot, not here shown, to receive a bolt 24 with a head 25, by which a clamp 18 is mounted on the underside of the short leg. The clamp 18 has a slide portion 20 and a finger 21 that engages the rung 3, as shown in FIG. 2. A wing nut 23 on the bolt 24 permits tightening and loosening of the bolt and therefore permits the clamp 18 to be moved away from the rung for installation and removal, and toward the rung for security.

Figure 4:
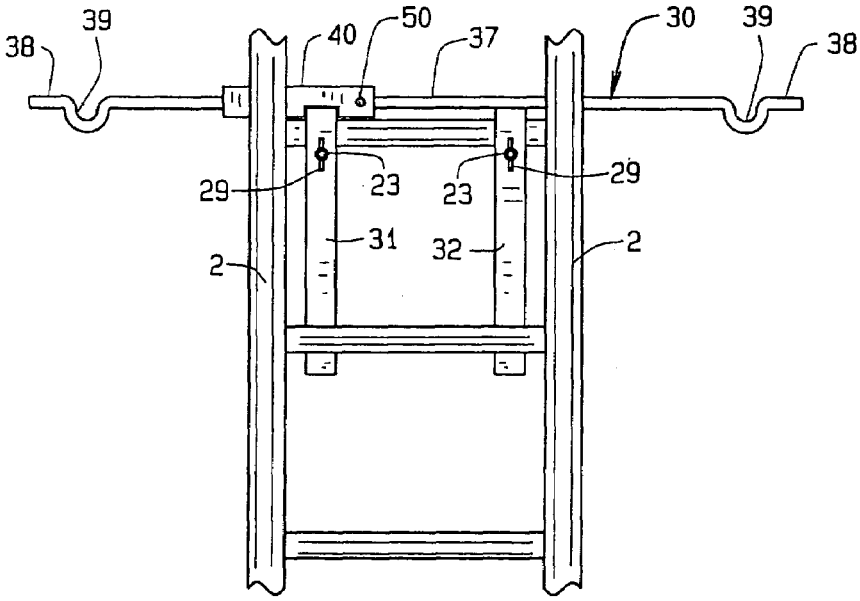
FIG. 4 is a view in front elevation of a second embodiment of attachment.
Figure 5:
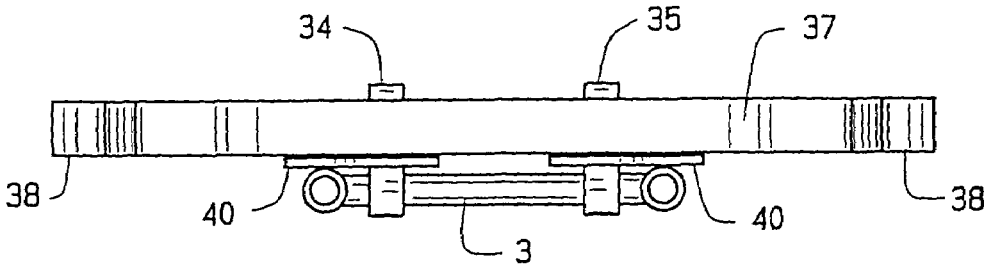
FIG. 5 is a top plan view of FIG. 4.
Figure 13:
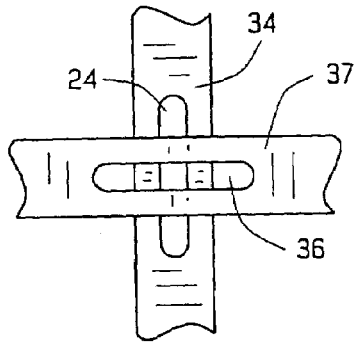
FIG. 13 is a fragmentary top plan view showing slots in a short leg and a support bar of attachments of the sort shown in FIGS. 4–12.
Figure 14:
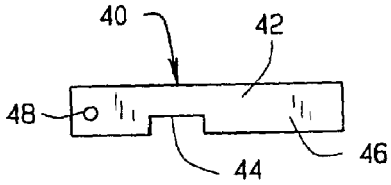
FIG. 14 is a view in front elevation of an unmounted latch member.

Referring to FIGS. 4 and 5 for a second embodiment, two long legs 31 and 32 with short legs 34 and 35, respectively, are positioned adjacent and parallel with opposite of the rails 2. As illustrated in FIGS. 4 and 5, the long legs extend rearwardly of the lower rung 4 and forwardly of the upper rung 3, and the short legs extend over the rung 3, in the same way as the short leg 14 of the first embodiment. However, in this embodiment, the short legs 34 and 35 carry a long support bar 37, extending parallel to the rung 3. The support bar 37 has bail-receiving channels 39 at each end, set in from projecting ends 38 of the bar. In this embodiment, a clamp 28, best shown as applied to another embodiment in FIG. 12, has a wing nut 23 extending through a slot 29 in the long leg. In this embodiment, a latch 40 is mounted on the bar 30. In fact, in this embodiment, two latches 40, as shown in FIG. 5 are provided. However, for clarity of illustration, only one of the latches is shown in FIG. 4. Each of the latches 40 has a body 42, as shown in FIG. 14, a relief 44 to accommodate the short legs 34 and 35, a wedging end surface 46, and a pin receiving hole 48 to receive a pin 50 welded or otherwise secured to the bar 37. The pin receiving hole 48 is sufficiently larger in diameter than the pin 50 to permit the latch to swing feely through 360 degrees. The bar 37 is spaced from the side rails the same distance as the thickness of the latch wedging surface 46, to admit the surface 46 closely. Contrary to what might be expected, when an unbalanced load, for example in FIG. 4 a bucket, is hung from the bar on the right side as viewed in FIG. 4, the wedging surface becomes tightly wedged between the bar and the rail 2. To insure that the bar and rail are positioned properly with respect to one another and with respect to the latch 40, the bar and short leg can be provided with slots 36 and 24, as shown in FIG. 13, to admit a wing nut and bolt to permit them to be clamped in exactly the right position. The slot 36 also permits the long legs to be moved closely adjacent the rails of an extension ladder, to compensate for differences in the lateral spacing of the rails.

Figure 6:
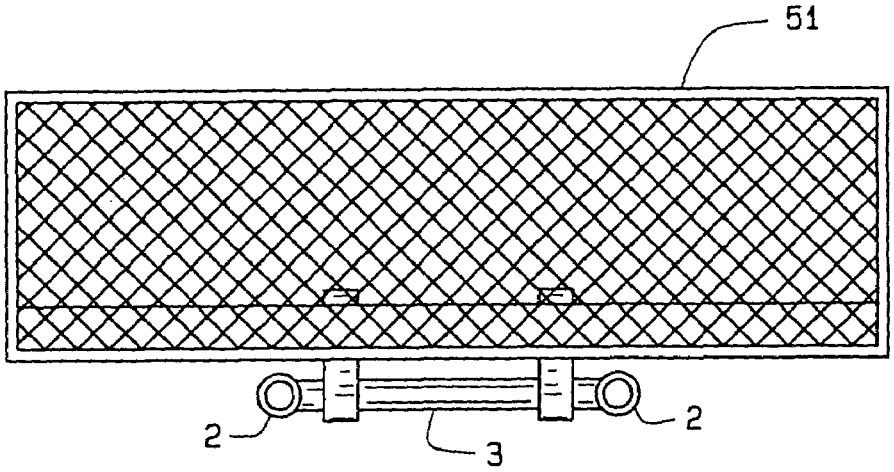
FIG. 6 is a top plan view of a third embodiment.

Referring now to FIG. 6 for another embodiment, the essential parts of the attachment are the same as those in FIG. 5, but the bar 37 in this embodiment supports a shelf 51 to accommodate any kind of container or tool.

Figure 7:
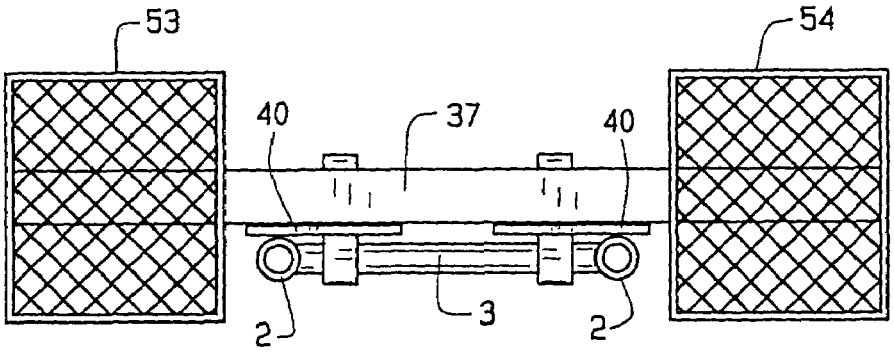
FIG. 7 is a top plan view of a fourth embodiment.

In FIG. 7, still another embodiment is shown, in which two shelves 53 and 54 are supported at opposite ends of the bar 37.

Figure 8:
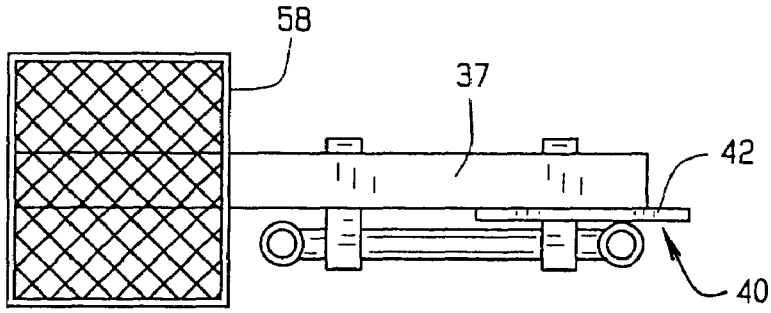
FIG. 8 is a top plan view of a fifth embodiment.
Figure 9:
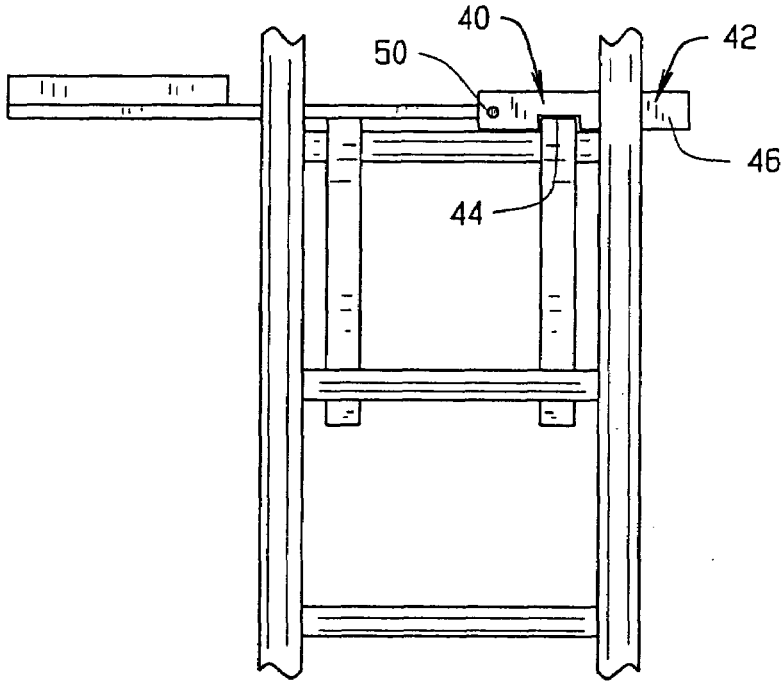
FIG. 9 is a fragmentary view in front elevation of FIG. 8.

In FIG. 8, yet another embodiment is shown in which a shelf 58 is supported by the bar 37 at only one end of the bar, so that a single latch 40 on the opposite end of the bar is sufficient.

Figure 10:
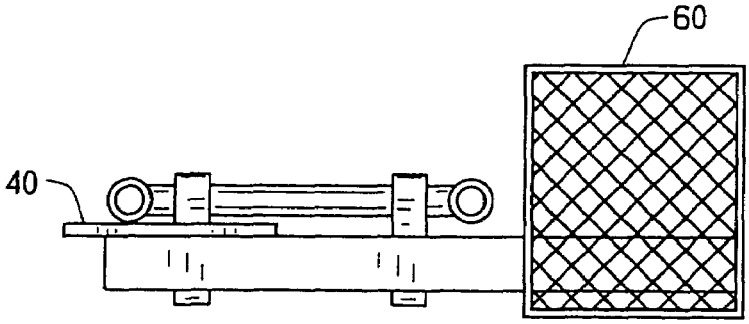
FIG. 10 is a top plan view of an embodiment in which a platform is supported.
Figure 11:
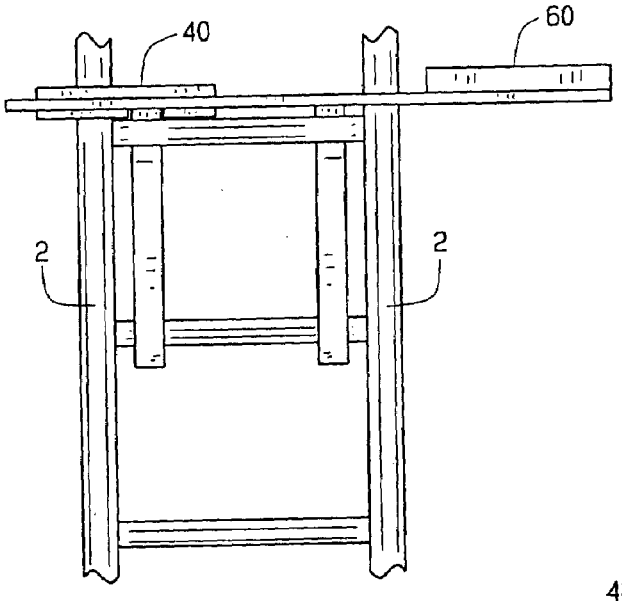
FIG. 11 is a fragmentary view in front elevation of the attachment shown in FIG. 10.
Figure 12:
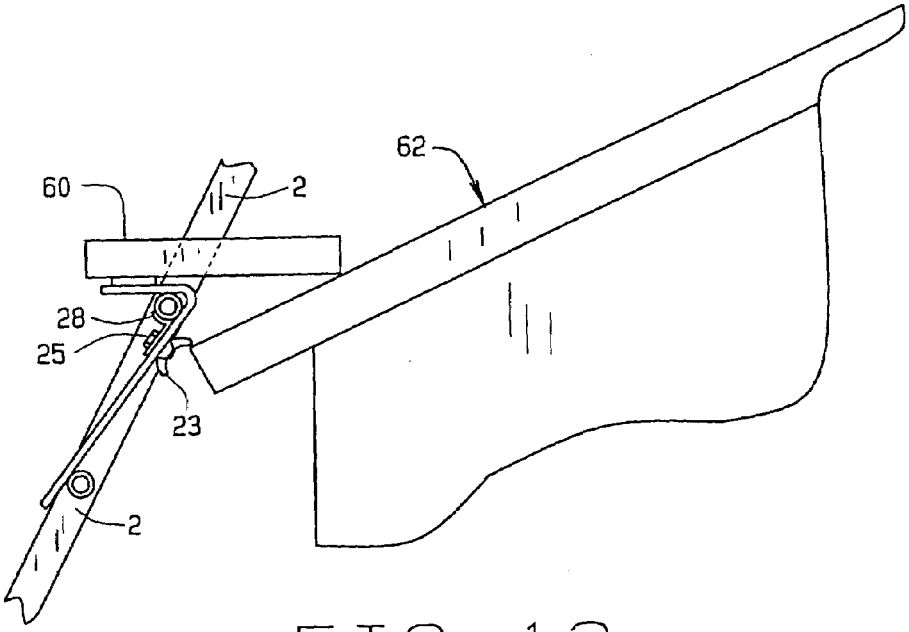
FIG. 12 is a view in side elevation of the assembly shown in FIG. 11, showing it in use as a platform adjacent a roof.

In FIGS. 10–12, the bar 37 is shown as supporting a platform 60. The attachment of FIGS. 10–12 is particularly useful for persons needing access to a roof, because it can be positioned as shown in FIG. 12, permitting the user to step onto the platform, holding onto the extended extension ladder, and directly onto a roof 62. It will be observed that in this embodiment, the long leg is positioned in front of a lower rung and behind an upper rung, with the short leg projecting forward of the ladder. The bar then lies along the front of the ladder.

Numerous variations in the construction of the attachment of this invention within the scope of the appended claims will occur to those skilled in the art in light of the foregoing description. Merely by way of illustration, In any of the embodiments described, the long leg can be positioned in front of the lower rung and behind the upper rung, the short leg extending forwardly. The clamps can be made with a forwardly extending foot that passes under the rail, positively to hold the short leg from moving upwardly. The bars can take the form of heavy tubes, square in cross section, or any other desired configuration. These are merely illustrative.

What is claimed is:

1. In combination with an extension ladder having elongated side rails and a multiplicity of rungs extending between and secured to said rails, said rungs being parallel with one another and spaced apart along a long dimension of said side rails, a holder comprising an L-shaped bracket, said bracket having at least one first leg longer than the distance between successive rungs, said first leg having an upper end and a lower end, said lower end being placed on one side of said lower rung and said upper end being placed on the other side of said upper rung, and a short leg integral with said first leg, projecting generally at right angles to said first leg, placed on top of said upper rung and extending beyond said rung and adapted to support an accessory, and a clamp, adjustably mounted on said short leg to engage said upper rung when the bracket is installed, for ensuring against dislodgement of said holder.

2. The combination of claim 1 wherein said lower end of said first leg is placed behind said lower rung and said upper end is placed in front of said upper rung, and said short leg projects over the upper rung and extends rearwardly from the said upper rung.

3. The combination of claim 2 wherein said bracket has two first legs and two short legs, spaced from one another in a direction crosswise of said ladder but within the ambit of said side rails, a bar extending between said short legs and a tray mounted on said short bar.

4. The combination of claim 1 wherein said lower end of said first leg is placed in front of said lower rung and said upper end is placed behind said upper rung, and said short leg projects over the upper rung and extends forwardly from said upper rung.

5. The combination of claim 4 wherein said bracket has two first legs and two short legs, spaced from one another in a direction crosswise of said ladder but within the ambit of said side rails, a bar between said short legs, adjustably mounted on said short legs for movement toward and away from said upper rung, and a tray mounted on at least one end of said bar.

6. The combination of claim 4 wherein said bracket has two first legs and two short legs, said legs being spaced from one another in a direction crosswise of said ladder but within the ambit of said side rails, a bar between said short legs, adjustably mounted on said short legs for movement toward and away from said upper rung, a tray mounted on one end of said bar, and a clamp mounted adjacent the end of said bar opposite the end on which the tray is mounted.

7. The combination of claim 6 wherein the clamp comprises a flat plate pivotally mounted on said bar at one end of said plate, on a pivot oriented generally perpendicularly to said rung and inboard of one of said short legs, said plate having a cut out part to straddle said short leg and being of a thickness to fit closely between said bar and a contiguous rail.

8. The combination of claim 7 wherein said tray is a platform capable of supporting a person, said platform being secured to an end part of said bar extending beyond a rail to permit at least a part of the platform to be positioned along an outer edge of a roof and to permit a person climbing the ladder to step on the platform, thence onto the roof.

* * * * *